US011643799B2

(12) United States Patent
Ishimi

(10) Patent No.: US 11,643,799 B2
(45) Date of Patent: May 9, 2023

(54) FLUSH TOILET

(71) Applicant: TOTO LTD., Kitakyushu (JP)

(72) Inventor: Wataru Ishimi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 17/678,454

(22) Filed: Feb. 23, 2022

(65) Prior Publication Data

US 2022/0275622 A1 Sep. 1, 2022

(30) Foreign Application Priority Data

Feb. 26, 2021 (JP) ..... JP2021-030147

(51) Int. Cl.
*E03D 11/08* (2006.01)

(52) U.S. Cl.
CPC ..... *E03D 11/08* (2013.01)

(58) Field of Classification Search
CPC ..... E03D 11/08
USPC ..... 4/420
See application file for complete search history.

(56) References Cited

U.S. PATENT DOCUMENTS

| | | | | |
|---|---|---|---|---|
| 10,465,369 | B2 * | 11/2019 | Kashirajima | E03D 11/06 |
| 10,633,849 | B2 * | 4/2020 | Kashirajima | E03D 11/08 |
| 2018/0087255 | A1 | 3/2018 | Kashirajima et al. | |

FOREIGN PATENT DOCUMENTS

| | | | |
|---|---|---|---|
| JP | 2005-113642 | A | 4/2005 |
| JP | 2007-169964 | A | 7/2007 |
| JP | 2014-152468 | A | 8/2014 |
| JP | 2015-135041 | A | 7/2015 |
| JP | 2018-048518 | A | 3/2018 |
| JP | 2018-080503 | A | 5/2018 |

OTHER PUBLICATIONS

"Notice of Reasons for Refusal" Office Action issued in JP 2021-030147; mailed by the Japanese Patent Office dated Jul. 25, 2022.
"Decision to Grant a Patent" Office Action issued in JP 2021-030147; mailed by the Japanese Patent Office dated Sep. 12, 2022.

* cited by examiner

*Primary Examiner* — Lauren A Crane
(74) *Attorney, Agent, or Firm* — Studebaker & Brackett PC

(57) ABSTRACT

A flush toilet of the present invention includes: a bowl including a waste receiving surface, a rim and a shelf surface, the shelf surface of the bowl including linear portions formed on a right side and a left side, a front arc portion connected to front ends of the linear portions, and a rear arc portion connected to rear ends of the linear portions; a rim spout portion spouting flush water to the shelf surface to form a circulating flow; and the like. Flush water is spouted backward from the rim spout port along the linear portions of the shelf surface; and the shelf surface and the waste receiving surface are coupled by an inner coupling portion, and a curvature radius of the inner coupling portion along a vertical direction is set to a smaller value on a rear end of the bowl than on a front end thereof.

4 Claims, 9 Drawing Sheets

| POSITION OF SHELF SURFACE | RELATIVE HEIGHT H (mm) OF SHELF SURFACE |
|---|---|
| A | 0 |
| C | 15 |
| D(D1) | 18 |
| E | 18 |
| G | 18 |
| I | 18 |
| J | 18 |
| K | 15 |
| A | 0 |

| POSITION OF SHELF SURFACE | SHELF WIDTH W (mm) OF SHELF SURFACE |
|---|---|
| A | 35 |
| B | 27.5 |
| D1(D) | 30 |
| F | 20 |
| G | 20 |
| H | 20 |
| J | 25 |
| L | 27.5 |
| A | 35 |

| POSITION OF SHELF SURFACE | CURVATURE RADIUS R3 (mm) OF INNER COUPLING PORTION |
|---|---|
| A | 45 |
| B | 36 |
| D(D1) | 27.5 |
| F | 27.5 |
| G | 25 |
| H | 27.5 |
| J | 27.5 |
| L | 36 |
| A | 45 |

| POSITION OF SHELF SURFACE | CURVATURE RADIUS R4 (mm) OF OUTER COUPLING PORTION |
|---|---|
| A | 7 |
| B | 4 |
| D(D1) | 4 |
| F | 10 |
| G | 15 |
| H | 12 |
| J | 9 |
| L | 7 |
| A | 7 |

FLUSH TOILET

BACKGROUND OF THE INVENTION

Field of the Invention

The present invention relates to a flush toilet, and in particular to such a flush toilet that the shelf surface of a bowl is formed to include linear portions.

Description of the Related Art

Recent flush toilets are adapted to perform washing with flush water at a small flow rate to discharge waste. However, it is necessary to favorably wash the whole bowl surface even when the flow rate of flush water is small.

In the flush toilet of Japanese Patent Laid-Open No. 2018-48518 (Patent Literature 1), by reducing the width of a shelf of a rear area of a bowl where waste easily adheres and, furthermore, increasing a curvature radius of an outer coupling portion that couples an end portion and a waste receiving surface, in the vertical direction in the rear area of the bowl, flush water spouted backward is caused to smoothly flow from the shelf into the rear area of the bowl so that the rear area of the bowl is sufficiently washed away.

In a flush toilet, it is necessary to perform washing with flush water and flow the flush water evenly on the whole surface of a bowl to discharge waste. However, when the flow rate of the flush water is small, there is a possibility that unwashed parts occur on the bowl.

In the flush toilet of Patent Literature 1 described above, it is prevented that unwashed parts occur in the rear area of the bowl. In the flush toilet, however, it is not possible to flow flush water evenly on the whole surface of the bowl, and further improvement is requested.

Especially, in such a flush toilet that the shelf of a bowl includes linear portions, since the flow path resistance of the linear portions of the shelf is small, it is difficult for a circulating flow of flush water to flow down to a waste receiving surface of the bowl, and, thereby, an unwashed parts may occur on the waste receiving surface of the bowl. Therefore, in the case of developing such a flush toilet that the shelf of the bowl includes linear portions, it is necessary to solve the above problem.

An object of the present invention is to provide a flush toilet capable of preventing occurrence of unwashed parts by flowing flush water evenly on the whole waste receiving surface of a bowl even if the flow rate of the flush water is small.

SUMMARY OF THE INVENTION

In order to achieve the above object, the present invention is a flush toilet for discharging waste by using flush water, the flush toilet including: a bowl including a waste receiving surface configured to receive the waste, a rim formed on a top edge of the waste receiving surface, and a shelf surface formed between the waste receiving surface and the rim, the shelf surface of the bowl including linear portions formed on a right side and a left side when seen from forward, a front arc portion connected to front ends of the linear portions, and a rear arc portion connected to rear ends of the linear portions; a rim spout portion configured to spout flush water from a rim spout port provided on the rim to the shelf surface to form a circulating flow; and a water conduit configured to guide flush water supplied from a flush water supply source to the rim spout portion; wherein flush water is spouted backward from the rim spout port of the rim spout portion along the linear portions of the shelf surface; and the shelf surface and the waste receiving surface are coupled by an inner coupling portion, and a curvature radius of the inner coupling portion along a vertical direction is set to a smaller value on a rear end of the bowl than on a front end thereof.

In the flush toilet in which the shelf surface of the bowl is formed by the linear portions formed on the right side and the left side when seen from forward, the front arc portion connected to the front ends of the linear portions, and the rear arc portion connected to the rear ends of the linear portions, when a circulating flow of flush water flows on the shelf surface, it is difficult for the flush water to flow down from the shelf surface to the waste receiving surface at the time of flowing from the front arc portion or the rear arc portion to the linear portions because the flow path resistance of the circulating flow is small on the linear portions (because the circulating flow is rectified). On the other hand, at the time of flowing from the linear portions to the front arc portion or the rear arc portion, it is easy for flush water to flow down from the shelf surface to the waste receiving surface because the circulating flow is disturbed on the front and rear arc portions. Since the rim spout port of the rim spout portion spouts flush water backward along the linear portions of the shelf surface of the bowl, it is difficult for the flush water to flow down on the waste receiving surface near the rim spout port, and unwashed parts easily occur.

Therefore, in the present invention, the curvature radius of the inner coupling portion that couples the shelf surface and the waste receiving surface, along the vertical direction is set to a smaller value at the rear end of the bowl than at the front end thereof. Therefore, in the case of washing the rear area of the bowl, flush water easily flows down at the rear end of the bowl because the flush water flows from the linear portions to the rear arc portion and has a momentum, and disturbance increases. However, by setting the curvature radius of the inner coupling portion to a smaller value than at the front end thereof, the flush water is prevented from flowing down too much. Furthermore, in the case of washing the front area of the bowl, since the momentum of flush water flowing from the linear portions to the front arc portion is weak, and disturbance is small at the front end of the bowl, it is difficult for the flush water to flow down. Therefore, by setting the curvature radius of the inner coupling portion to a larger value than at the rear end of the bowl, the flush water is caused to easily flow down. Furthermore, it is also difficult for flush water flowing from the front arc portion to the linear portions to flow down. Therefore, by increasing the curvature radius of the inner coupling portion at the front end of the bowl, the flush water is caused to easily flow down, and it is possible to prevent unwashed parts from occurring on the waste receiving surface near the rim spout port.

In the present invention, preferably, the curvature radius of the inner coupling portion that couples the shelf surface and the waste receiving surface is set so that a value increases from the rear end of the bowl toward the front end thereof.

In the present invention, flush water is spouted backward from the rim spout port. Therefore, flush water has a stronger momentum and is more largely disturbed in the rear area of the bowl than in the front area thereof, and the flush water easily flows down from the shelf surface to the waste receiving surface. In the front area of the bowl, flush water has a weaker momentum, and disturbance is smaller than in the rear area thereof. Therefore, it is difficult for the flush water to flow down from the shelf surface to the waste receiving surface. Therefore, in the present invention, the curvature radius of the inner coupling portion that couples the shelf surface and the waste receiving surface is set so that the value increases from the rear end of the bowl toward the front end thereof. Thus, flush water does not flow down too much in the rear area of the bowl, and it is easy for flush water to flow down in the front area, so that it is possible to prevent occurrence of unwashed parts on the waste receiving surface of the bowl.

In the present invention, preferably, the shelf surface and the rim are coupled by an outer coupling portion, and a curvature radius of the outer coupling portion along a vertical direction is set so that a value increases from the rear end of the bowl toward the front end thereof.

In the present invention configured as described above, the curvature radius of the outer coupling portion that couples the shelf surface and the rim, along the vertical direction is set so that the value increases from the rear end of the bowl toward the front end thereof. Therefore, when it is difficult for flush water to flow down from the shelf surface to the waste receiving surface in the front area of the bowl, it becomes easy for the flush water to flow down in the rear area of the bowl, and it is possible to, by causing an appropriate amount of flush water to flow down into the rear area of the bowl to wash away adhering waste.

In the present invention, preferably, the shelf surface is formed such that a shelf width thereof is the widest at the front end of the bowl and the narrowest at the rear end of the bowl.

In the present invention configured as described above, though the momentum of flush water is weak in the front area of the bowl, it is possible to, because the shelf width of the shelf surface is formed the widest at the front end of the bowl, maintain the flush water by the shelf surface and cause the flush water to whirl to the vicinity of the rim spout port and flow down. On the other hand, since the momentum of flush water is strong in the rear area of the bowl, the flush water does not flow down too much even though the shelf width of the shelf surface is formed to be the narrowest at the rear end of the bowl.

According to the flush toilet of the present invention, it is possible to prevent occurrence of unwashed parts by flowing flush water evenly on the whole waste receiving surface of the bowl even if the flow rate of the flush water is small.

DETAILED DESCRIPTION OF THE PREFERRED EMBODIMENT

Next, a basic structure of a flush toilet according to an embodiment of the present invention will be described with reference to FIGS. 1 to 3.

Figure 1:
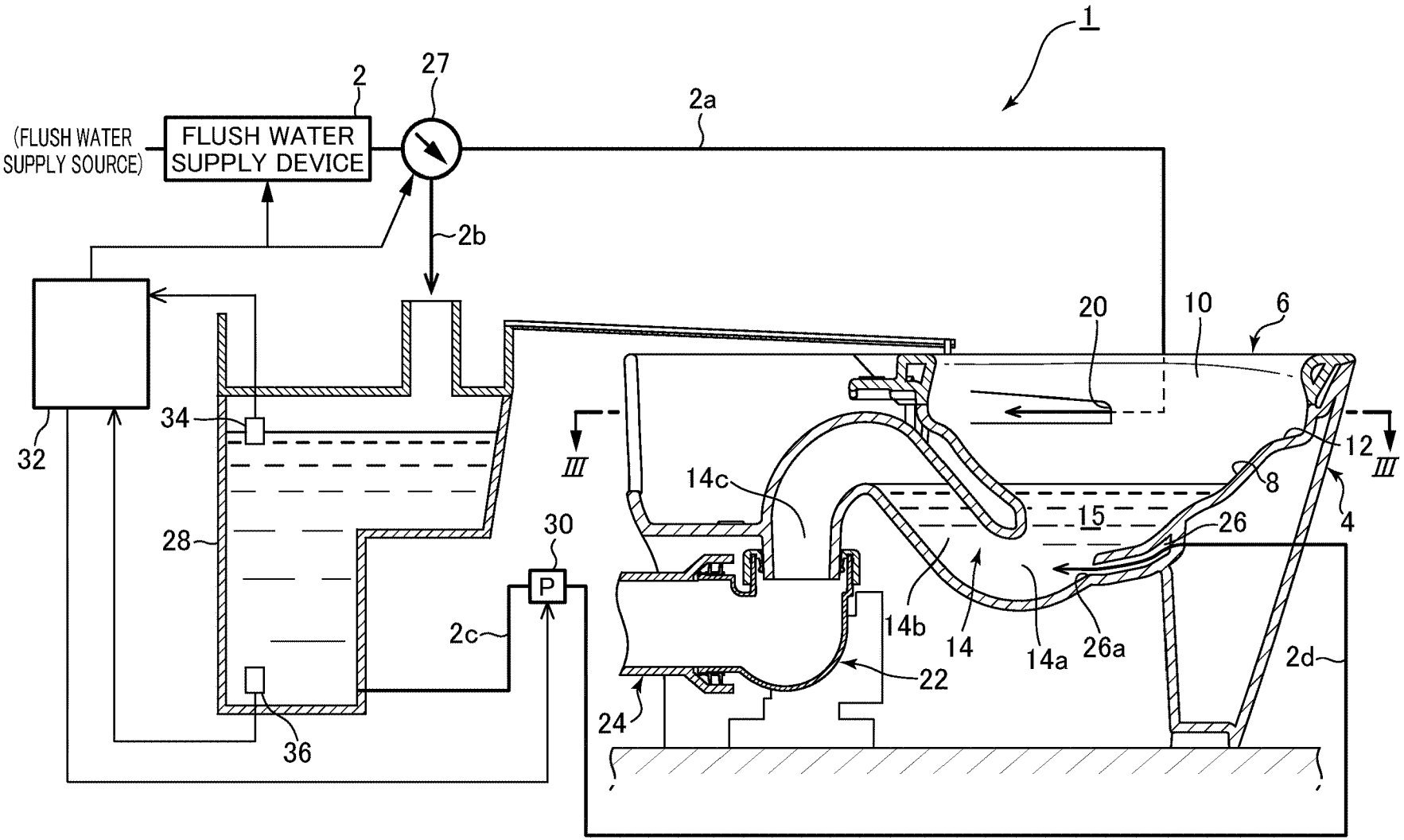
FIG. 1 is an overall schematic diagram showing a flush toilet according to an embodiment of the present invention.

First, as shown in FIG. 1, a flush toilet 1 according to one embodiment of the present invention is provided with a toilet main body 4 to which flush water is supplied from a flush water supply source such as a water tap via a flush water supply device 2.

The following description will be made on the assumption that, in the plan view shown in FIG. 2, a side located on the left side when the toilet main body 4 is seen from forward is a left side, and a side located on the right side is a right side.

Figure 2:
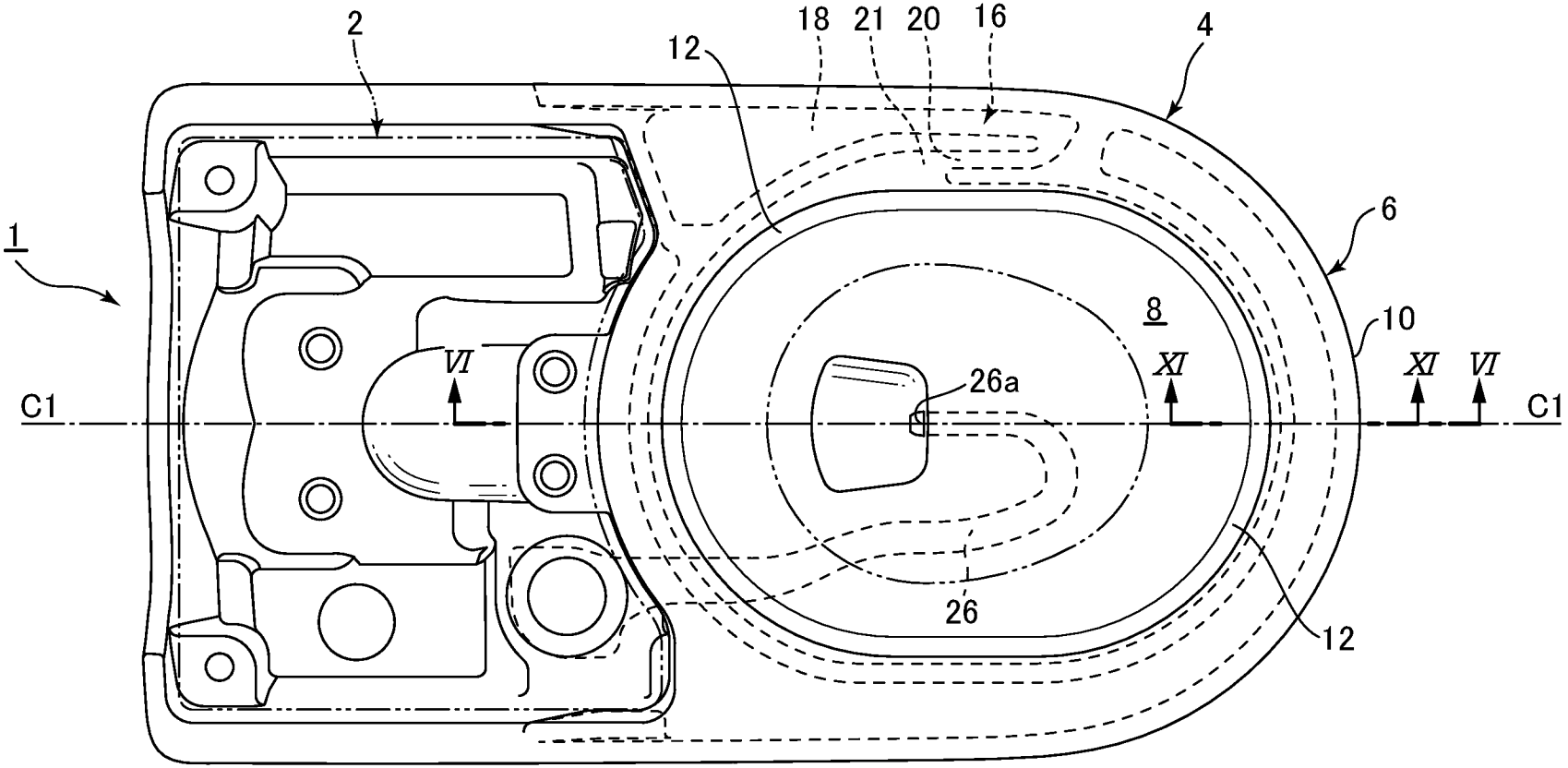
FIG. 2 is a plan view showing the flush toilet according to the embodiment of the present invention.

As shown in FIGS. 1 and 2, the toilet main body 4 has a bowl 6, and the bowl 6 is provided with a waste receiving surface 8 that receives waste, a rim 10 formed on the top edge of the bowl 6 and a shelf surface 12 formed between the waste receiving surface 8 and the rim 10. The shelf surface 12 is a flat surface that is slightly inclined inward, and the flat surface is formed on the entire circumference of the bowl 6.

The toilet main body 4 is further provided with a water discharge trap pipe 14 that extends from the bottom portion of the bowl 6. Above a communicating portion between the bottom portion of the bowl 6 and the water discharge trap pipe 14, pooled water 15 is formed.

Figure 3:
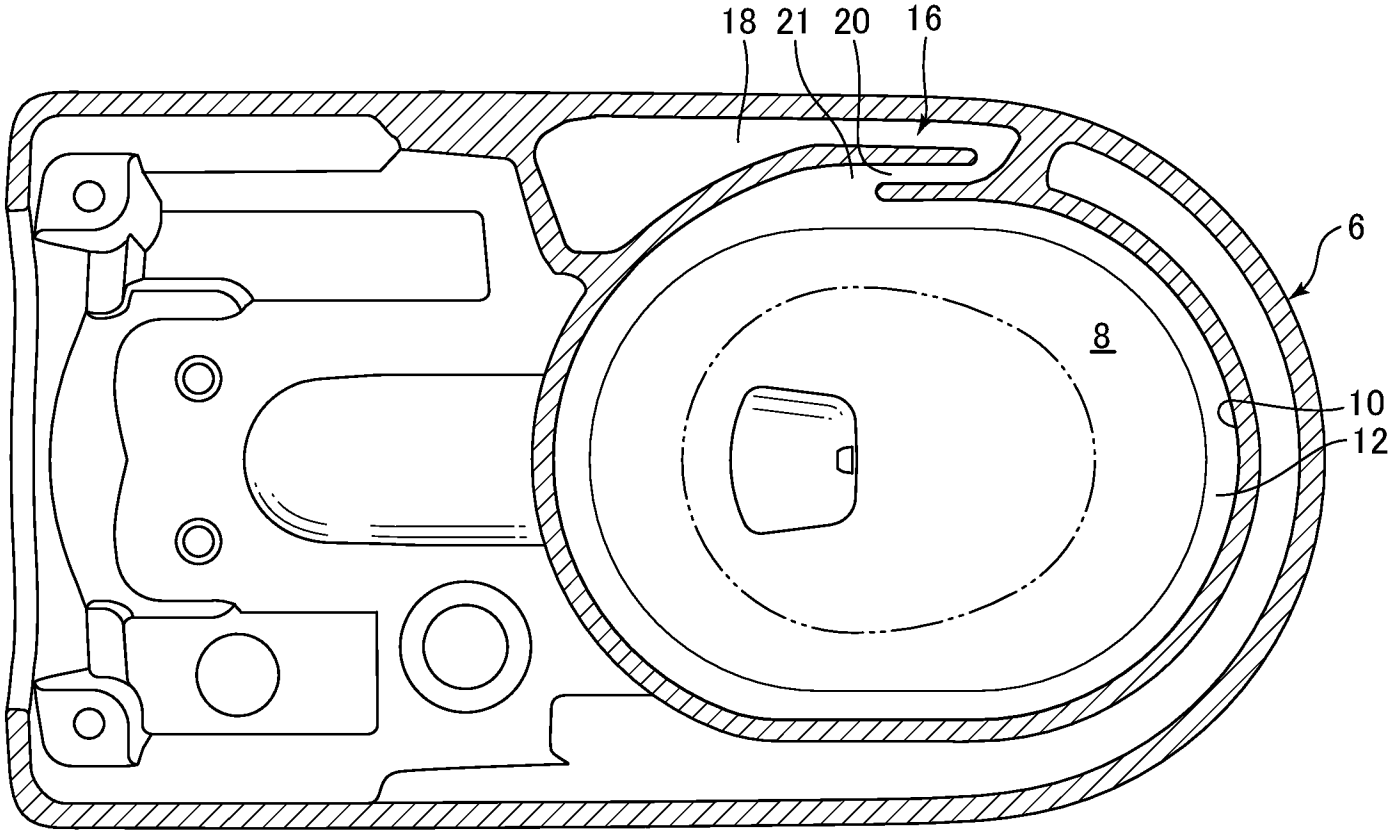
FIG. 3 is a sectional view seen along line III-III in FIG. 1.

As shown in FIGS. 1 to 3, on the rim 10 of the bowl 6, a rim spout portion 16 is formed which spouts flush water supplied from the flush water supply source into the bowl 6 to form a circulating flow in the bowl 6. The rim spout portion 16 is provided on the rim 10 on the right side when the toilet main body 4 of the bowl 6 is seen from forward. Further, for the rim spout portion 16, a rim water passage 18 through which supplied flush water passes is formed inside the rim 10, and, on the downstream end of the rim water passage 18, a rim spout port 20 for spouting flush water backward is formed.

In the present embodiment, the rim spout port 20 is a single spout port provided on the rim 10. Therefore, flush water with a strong momentum can be spouted from the rim spout port 20, and it becomes easy to wash the rear area of the bowl 6 that is easy to get dirty, and it is possible to reduce unwashed parts in an area X2 (see FIG. 5), as described later.

Inside the rim 10 on the right side when the toilet main body 4 is seen from the front side, the rim water passage 18 extends forward from the rear side of the toilet main body 4 and then bends inside at the middle toward the rear side, that is, forms a so-called U-turn shape. Furthermore, on the upstream side of the rim water passage 18, a rim-side water supply passage 2*a* of the flush water supply device 2 described above is connected. Furthermore, on the immediately downstream side of the rim spout port 20 of the rim 10 and on the outer circumferential side of the shelf surface 12, a spout port water passage surface 21 is formed. Over the spout port water passage surface 21, the inner circumferential surface of the bowl 6 overhangs. Flush water supplied from the rim-side water supply passage 2*a* to the rim water passage 18 is spouted backward to the spout port water passage surface 21, from the rim spout port 20, and, after that, spouted into the bowl 6 via the shelf surface 12. The flow rate of the flush water spouted from the rim spout port 20 is 10 L/min to 16 L/min.

As shown in FIGS. 1 and 2, the water discharge trap pipe 14 described above is provided with an inlet 14*a*, an ascending conduit 14*b* and a descending conduit 14*c*. A discharge socket 22 is connected to the descending conduit 14*c* of the water discharge trap pipe 14, and the downstream end of the discharge socket 22 is connected to a discharge pipe 24 (wall drainage). In the present embodiment, in addition to the wall drainage, a discharge socket may be connected to the floor so that flush water may be discharged to a discharge pipe provided in the floor (floor drainage).

A jet water conduit 26 is formed on the bottom portion of the bowl 6 of the toilet main body 4; a jet spout port 26*a* is formed at the downstream end of the jet water conduit 26; and the jet spout port 26*a* is oriented toward the inlet 14*a* of the water discharge trap pipe 14. Flush water is spouted from the jet spout port 26*a* toward the inlet 14*a* of the water discharge trap pipe 14 to perform jet spouting.

As shown in FIG. 1, a switching valve 27 is provided on the downstream side of the flush water supply device 2, and supply of flush water is switched to between the rim-side water supply passage 2*a* and a tank-side water supply passage 2*b* by the switching valve 27.

A reservoir tank 28 is provided on the downstream side of the tank-side water supply passage 2*b*, and a pressurizing pump 30 is connected to the downstream side of the reservoir tank 28 via a pump water supply passage 2*c*. A jet-side water supply passage 2*d* is connected to the downstream side of the pressurizing pump 30, and flush water in the reservoir tank 28 is supplied to the jet water conduit 26 described above by the jet-side water supply passage 2*d*.

The flush water supply device 2 described above is provided with a stop cock, a fixed flow valve, a diaphragm-type main valve, a solenoid valve and the like. The flush water supply device 2 is further provided with a controller 32, and opening/closing operations of the various kinds of valves described above, switching operations of the switching valve 27 and the number of rotations, operation time and the like of the pressurizing pump 30 are controlled by the controller 32.

Here, the switching valve 27 is also capable of supplying flush water to both of the rim-side water supply passage 2*a* and the tank-side water supply passage 2*b* at the same timing. In this case, the ratio of the amount of water supply to the rim side and to the tank side can be arbitrarily changed.

Due to the above, in the flush toilet 1 according to the present embodiment, flush water under direct water pressure is supplied to the rim spout port 20 from the rim-side water supply passage 2*a* of the flush water supply device 2 via the rim water passage 18 of the toilet main body 4 so that spouting from the rim spout port 20 (so-called "rim spouting") can be performed.

Furthermore, after passing through the tank-side water supply passage 2*b* of the flush water supply device 2, the reservoir tank 28, the pump water supply passage 2*c* and the pressurizing pump 30, flush water is supplied to the jet spout port 26*a* from the jet-side water supply passage 2*d* via the jet water conduit 26 of the toilet main body 4 so that spouting from the jet spout port 26*a* (so-called "jet spouting") can be performed.

The flush toilet 1 according to the present embodiment is a so-called hybrid-type flush toilet 1 that is adapted to use both of rim spouting by flush water under direct water pressure and jet spouting by flush water from the reservoir tank 28, which is pressurized by the pressurizing pump 30.

As shown in FIG. 1, inside the reservoir tank 28, an upper-side float switch 34 and a lower-side float switch 36 are arranged. The water level in the reservoir tank 28 can be detected by the float switches 34 and 36.

The upper-side float switch 34 is switched to ON when the water level in the reservoir tank 28 reaches a predetermined reservoir water level, and the controller 32 detects the ON state of the upper-side float switch 34 and causes the solenoid valve of the flush water supply device 2 to be closed.

On the other, the lower-side float switch 36 is switched to ON when the water level in the reservoir tank 28 drops to a predetermined water level lower than a predetermined reservoir water level detected by the upper-side float switch 34, and the controller 32 detects the ON state of the lower-side float switch 36 and causes the pressurizing pump 30 to stop.

The pressurizing pump 30 is adapted to be capable of, by absorbing flush water reserved in the reservoir tank 28 into the pump water supply passage 2*c* and pressurizing the flush water from the pump water supply passage 2*c* to the jet-side water supply passage 2*d*, causing the flush water to be spouted from the jet spout port 26*a*.

In the flush toilet 1 according to the present embodiment described above, at the time of washing the toilet bowl, the controller 32 detects an operation of a toilet bowl washing switch (not shown) or the like by a user and causes the flush water supply device 2 to operate to supply flush water from the flush water supply source to the toilet main body 4.

Thereby, spouting from the rim spout port 20 and spouting from the jet spout port 26*a* are sequentially started, and flush water that has washed the waste receiving surface 8 of the bowl 6 is discharged from the water discharge trap pipe 14 to the outside together with waste in the bowl 6.

Furthermore, after the washing ends, the controller 32 switches the switching valve 27 of the flush water supply device 2 to the tank-side water supply passage 2*b* side so that flush water is replenished into the reservoir tank 28.

Then, when the water level in the reservoir tank 28 rises, and the upper-side float switch 34 detects the predetermined reservoir water level, the controller 32 stops replenishment of flush water by the flush water supply device 2 into the reservoir tank 28.

Next, the structure of the shelf surface 12 of the bowl 6 and the like will be described in detail with reference to FIGS. 4 and 5.

Figure 4:
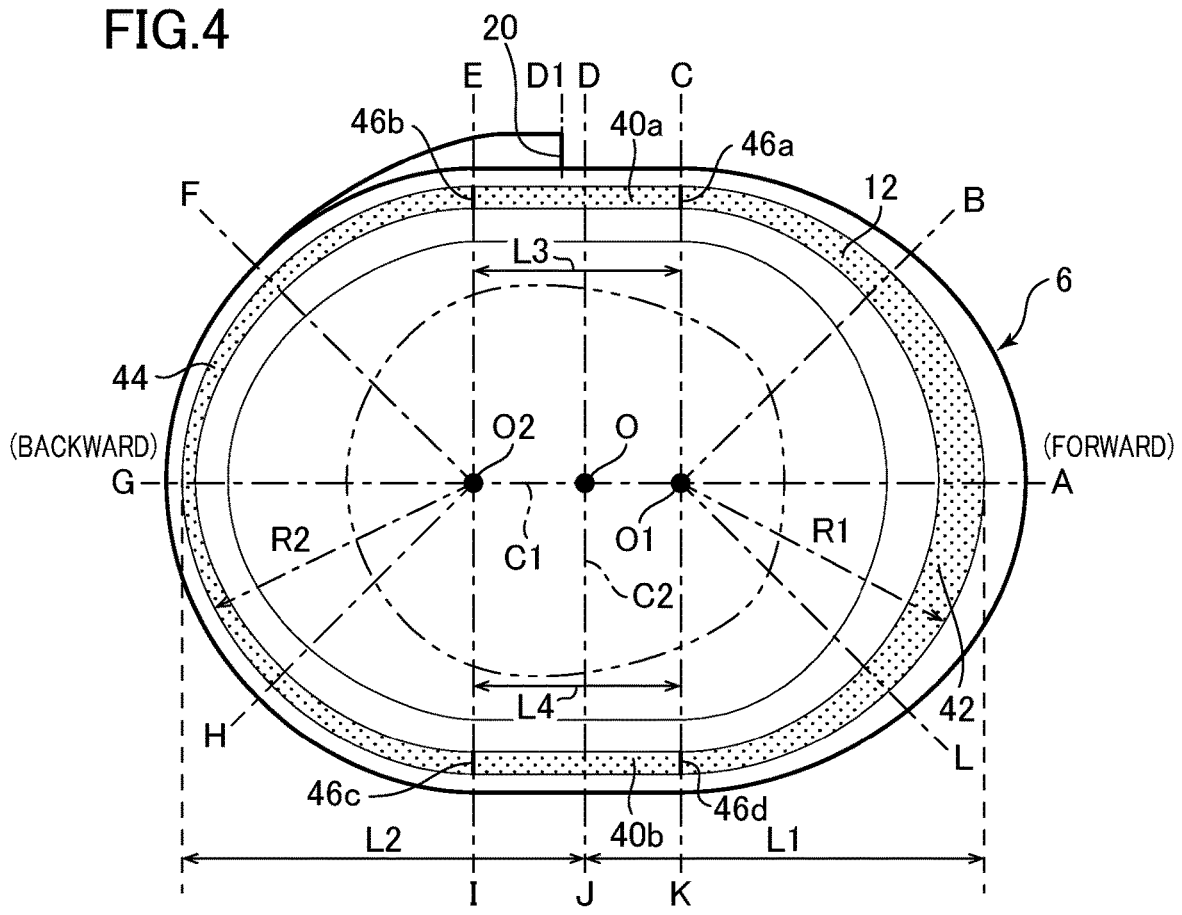
FIG. 4 is a plan view showing a bowl and a shelf of the flush toilet according to the embodiment of the present invention.

First, as shown in FIG. 4, the shelf surface 12 of the bowl 6 is formed by a right-side linear portion 40*a* and a left-side linear portion 40*b* extending in parallel on the right side and left side of the bowl 6, a front arc portion 42 connected to the front ends of the right-side and left-side linear portions 40*a* and 40*b*, and a rear arc portion 44 connected to the rear ends of the right-side and left-side linear portions 40*a* and 40*b* when seen from the top surface.

Specifically, the front end of the right-side linear portion 40*a* and the front arc portion 42 are coupled by a coupling portion 46*a*; the rear end of the right-side linear portion 40*a* and the rear arc portion 44 are coupled by a coupling portion 46*b*; the rear arc portion 44 and the rear end of the left-side linear portion 40*b* are coupled by a coupling portion 46*c*; and the front end of the left-side linear portion 40*b* is coupled with the front arc portion 42 by a coupling portion 46*d*.

Note that the right-side linear portion 40*a* and left-side linear portion 40*b* described above may be provided in a manner of extending "almost in parallel" on the right side and the left side.

Here, both of the front arc portion 42 and the rear arc portion 44 are formed with a single curvature radius R1.

Note that the front arc portion 42 and the rear arc portion 44 may be formed by combining a plurality of curvature radii.

To make a description more specifically, the shelf surface 12 of the bowl 6 is in a shape that is almost bilaterally symmetrical relative to a center line C1 extending in the front-rear direction and is also in a shape that is almost symmetrical in the front-rear direction relative to a center line C2 extending in the left-right width direction as shown in FIG. 4. The front arc portion 42 is in a semicircular shape with the single radius R1 having a center O1, and, similarly, the rear arc portion 44 is in a semicircular shape with a single radius R2 having a center O2.

Furthermore, in FIG. 4, a position A is the front end of the bowl 6; a position B is an intermediate position between the front end of the bowl 6 and the front end of the right-side linear portion 40*a*; a position C is the front end of the right-side linear portion 40*a*; a position D is an intermediate position of the right-side linear portion 40*a*; a position D1 is the position of the rim spout port 20; and the position D and the position D1 are almost the same position. A position E is an intermediate position between the rear end of the right-side linear portion 40*a* and the rear end of the bowl 6; a position G is the rear end of the bowl 6; a position H is an intermediate position between the rear end of the bowl 6 and the rear end of the left-side linear portion 40*b*; a position I is the rear end of the left-side linear portion 40*b*; a position J is an intermediate position of the left-side linear portion 40*b*; a position K is the front end of the left-side linear portion 40*b*; and a position L is an intermediate position between the front end of the left-side linear portion 40*b* and the front end of the bowl 6.

Here, a length L2 in the front-rear direction from the center line C2 to the position G is longer than a length L1 in the front-rear direction from the center line C2 to the position A. Therefore, when a user excretes in a standing or sitting position, the waste receiving surface 8 in the rear area of the bowl 6 is large, and a sense of safety at the time of excretion can be increased. Further, a length L3 in the front-rear direction from the position C to the position E and a length L4 in the front-rear direction from the position I to the position K are almost the same. Furthermore, a length in the front-rear direction from the position E (the position I) to the position G (=R2) and a length in the front-rear direction from the position C (the position K) to the position A (=R1) are longer than the length L3 in the front-rear direction and the length L4 in the front-rear direction. In other words, the curvature radius R1 of the front arc portion 42 and the curvature radius R2 of the rear arc portion 44 are longer than the length L3 of the right-side linear portion 40*a* in the front-rear direction and the length L4 of the left-side linear portion 40*b* in the front-rear direction. As a result, when flush water flows from the linear portions 40*a* and 40*b* to the arc portions 42 and 44, change in the flow of the flush water is gradual because the curvature radii R1 and R2 of the arc portions 42 and 44 are set long, and it is possible to prevent splattering of the flush water.

Next, the behavior of flush water flowing on the shelf surface 12 of the bowl 6 will be described with reference to FIG. 5. As shown in FIG. 5, the flow of flush water flowing from the right-side linear portion 40*a* to the rear arc portion 44 is indicated by F1; the flow of flush water flowing from the rear arc portion 44 to the left-side linear portion 40*b* is indicated by F2; the flow of flush water flowing from the left-side linear portion 40*b* to the front arc portion 42 is indicated by F3; and the flow of flush water flowing from the front arc portion 42 to the right-side linear portion 40*a* is indicated by F4.

Here, it is difficult for flush water flowing on the right-side and left-side linear portions 40*a* and 40*b* of the shelf surface 12 to flow down to the waste receiving surface 8 because there is little flow path resistance. On the other hand, the flow of flush water flowing on the front arc portion 42 and the rear arc portion 44 is disturbed because the flow direction changes, and thus it is easy for the flush water to flow down to the waste receiving surface 8 due to the disturbance of the flow. The influence of the disturbance of the flow is greater than the influence of centrifugal force.

Therefore, as for the flows F2 and F4 of flush water flowing from the arc portions 42 and 44 to the linear portions 40*a* and 40*b*, it is difficult for the flush water to flow down from the shelf surface 12, but on the other hand, as for the flows F1 and F3 of flush water flowing from the linear portions 40*a* and 40*b* to the arc portions 42 and 44, it is easy for the flush water to flow down from the shelf surface 12. Due to such behavior of flush water, unwashed parts easily occur on the waste receiving surface 8 in areas X1 and X2 where flush water flows from the arc portions 42 and 44 to the linear portions 40*a* and 40*b*.

Here, in the rear area (including the area X2) of the bowl 6, flush water is spouted backward from the rim spout port 20 provided at the position D1, and the distance from the rim spout port 20 is relatively short. Therefore, the flush water has a strong momentum and is disturbed much, and thus it is easy for the flush water to flow down from the rear arc portion 44. Thus, it is difficult for unwashed parts to occur. On the other hand, in the front area (including the area X1) of the bowl 6, the momentum of flush water is weak, and the flush water is disturbed less. Therefore, it is difficult for the flush water to flow down from the front arc portion 42, and thus unwashed parts easily occur.

Figure 5:
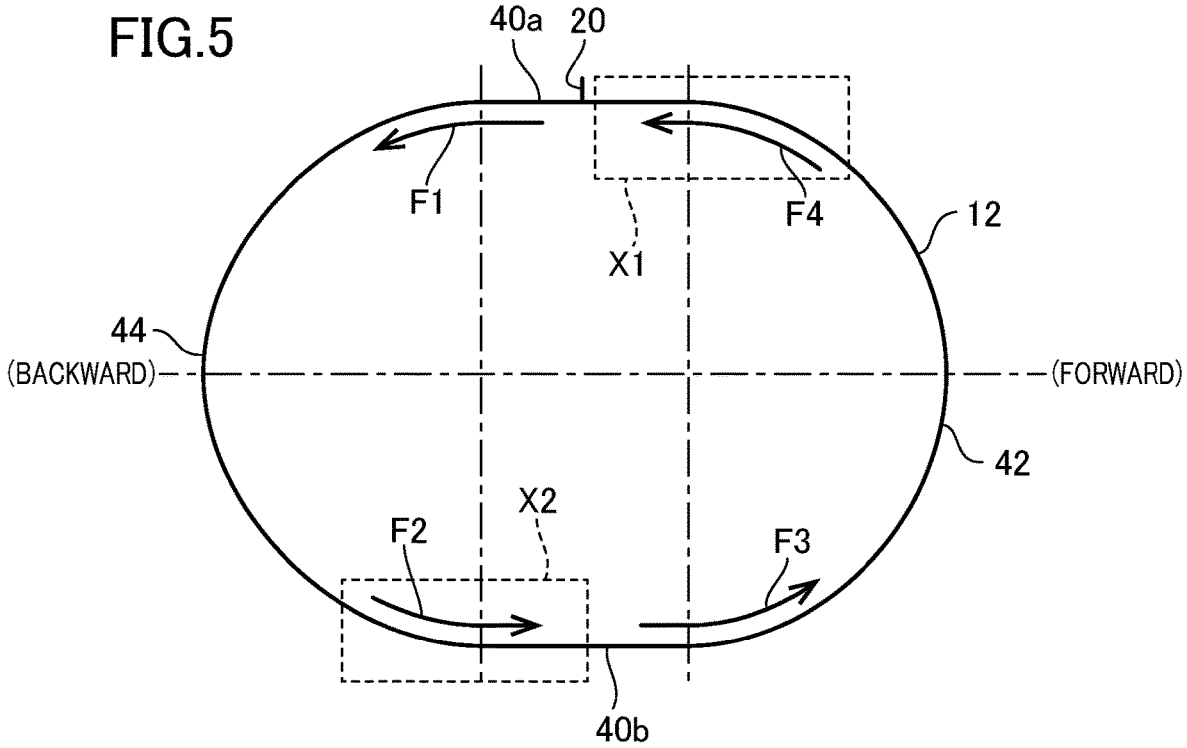
FIG. 5 is a schematic plan view of the shelf for illustrating a flow of flush water on the shelf of the flush toilet according to the embodiment of the present invention.

In the present embodiment, the area X1 in FIG. 5, that is, the shelf surface 12 located from the front arc portion 42 to the right-side linear portion 40*a* has a sloped surface (an ascending surface) 50 that ascends toward the rim spout port 20.

The ascending sloped surface (the ascending surface) 50 will be described in detail with reference to FIGS. 6 to 8.

Figures 6, 7:
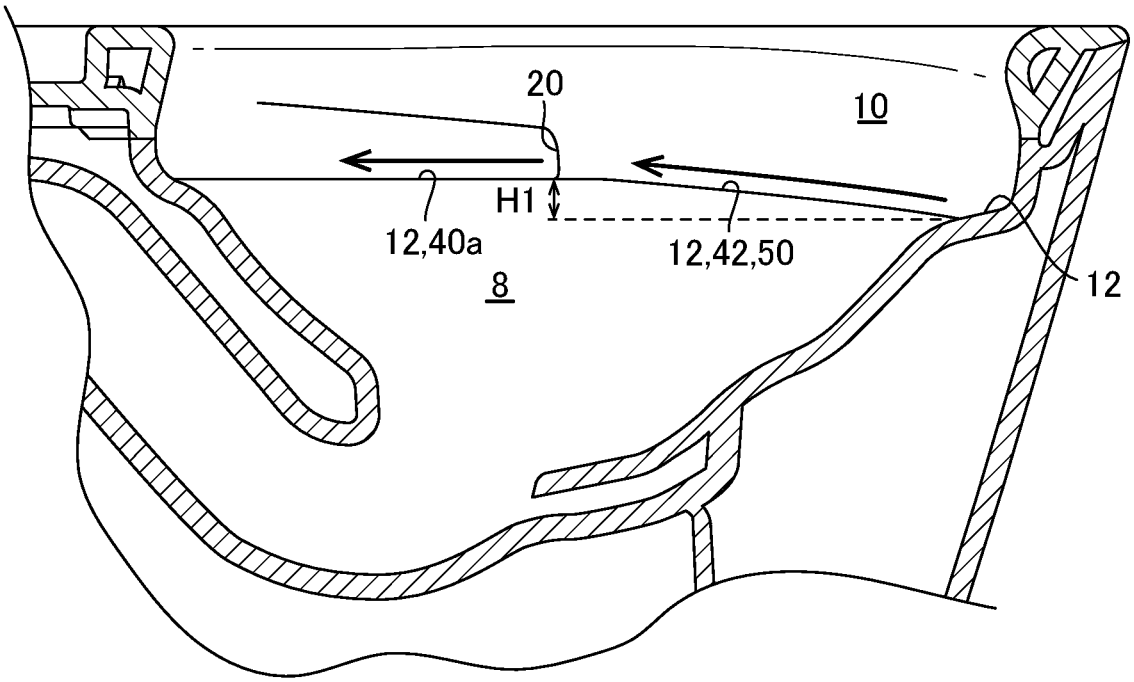
FIG. 6 is a partial sectional view seen along line VI-VI in FIG. 2.
FIG. 7 is a table showing relative heights H of a shelf surface on the entire circumference of the bowl.
Figures 8, 9:
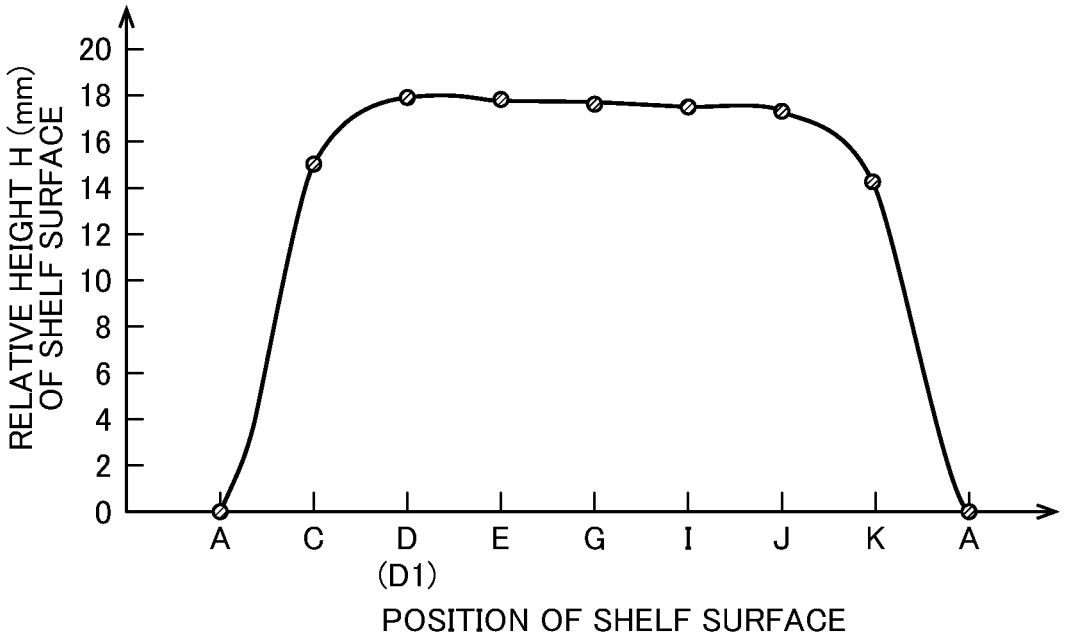
FIG. 8 is a line graph showing the relative heights H of the shelf surface on the entire circumference shown in FIG. 7.
FIG. 9 is a table showing widths W of the shelf surface on the entire circumference of the bowl.

First, as shown in FIGS. 6 to 8, relative heights H on the entire circumference of the shelf surface 12 of the bowl 6 are not the same. The shelf surface 12 is the lowest at the front end of the bowl 6 (the position A), and the sloped surface (the ascending surface) 50 that ascends toward the rim spout port 20, from the front end of the bowl 6 to the rim spout port 20 (the position D1) (or the central position D of the right-side linear portion 40*a*) is formed. Furthermore, the shelf surface 12 is formed with the same height from the rim spout port 20 (the position D1) (or the central position D of the right-side linear portion 40*a*) to the central position J of the left-side linear portion 40*b* via the rear end of the bowl 6 (the position G). Furthermore, the shelf surface 12 has a sloped surface (a descending surface) 52 that descends toward the front end, from the central position J of the left-side linear portion 40*b* to the front end of the bowl 6 (the position A).

Here, since the top portion of the rim 10 is formed almost the same, the front end of the rim 10 is higher than the rear end, relative to the shelf surface 12. Therefore, at the time of excretion in a sitting position, urine and the like hit the front end of the bowl 6 and can be prevented from being splattered from the bowl 6.

In the flush toilet 1 according to the present embodiment, since the shelf surface 12 has the ascending surface 50, in the area X1 (that is, an area across the coupling portion 46*a* where the front arc portion 42 and the right-side linear portion 40*a* are connected) as described above, the flow velocity of flush water decreases, and, thereby, it is possible to prevent unwashed parts from occurring on the waste receiving surface 8 that is a lower part of the shelf surface 12 that is in the area of the rim spout port 20 (or the central position D of the right-side linear portion 40*a*).

Here, as shown in FIGS. 7 and 8, the shelf surface 12 is the lowest at the front end of the bowl 6 (the position A) and is formed at a certain height higher than the position A, in an area from the central part of the right-side linear portion 40*a* (the position D) to the central part of the left-side linear portion 40*b* (the position J) via the rear end of the bowl 6 (the position G).

Furthermore, as shown in FIGS. 7 and 8, the relative heights of the shelf surface 12 of the right-side linear portion 40*a*, the rear arc portion 44 and the left-side linear portion 40*b* are almost the same.

Though the above-described ascending sloped surface (the ascending surface) 50 the shelf surface 12 has extends from the front end of the bowl 6 (the position A) to the rim spout port 20 (the position D1), the sloped surface (the ascending surface) 50 is not limited thereto and may be formed on the shelf surface 12 between the position A and the position D1. Furthermore, it is preferable that the ascending surface 50 is formed across the coupling portion 46*a* that connects the front arc portion 42 and the right-side linear portion 40*a*.

It is preferable that an ascending height H1 of the above-described ascending sloped surface (the ascending surface) 50 that the shelf surface 12 is provided with is 15 to 20 mm.

Next, shelf widths W of the shelf surface 12 will be described with reference to FIGS. 9 and 10.

Figure 10:
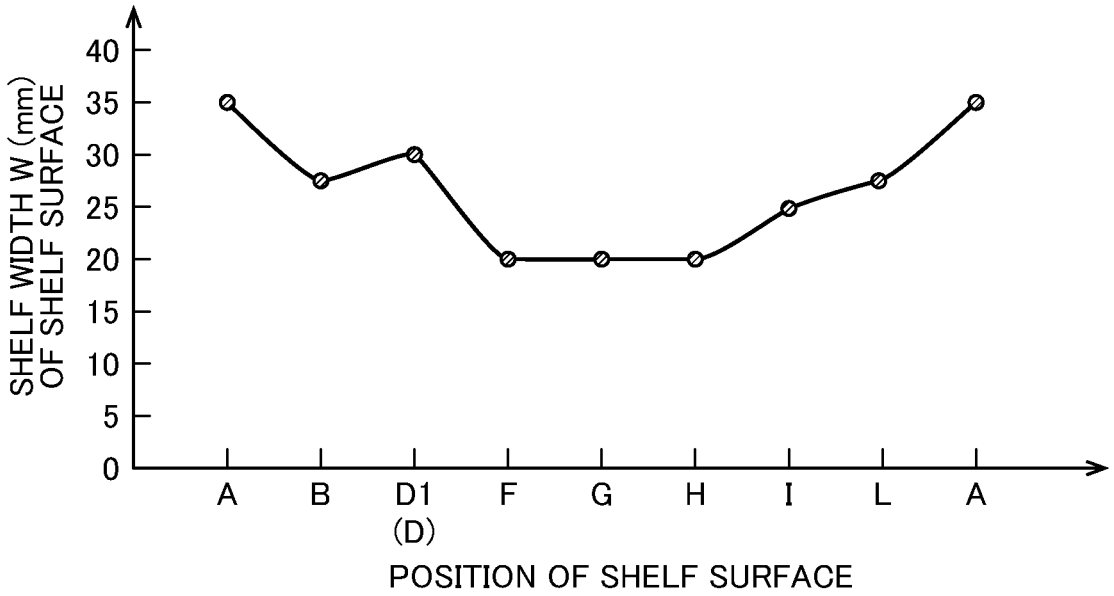
FIG. 10 is a line graph showing the widths W of the shelf surface on the entire circumference shown in FIG. 9.

As shown in FIGS. 9 and 10, the shelf width W of the shelf surface 12 is the widest at the front end of the bowl 6 (the position A) and the narrowest at the rear end of the bowl 6 (the position G). The shelf width W of the shelf surface 12 near the rim spout port 20 (the position D1) is a little wider than other areas of the right-side linear portion 40*a* in order to stabilize spouting of flush water.

Here, it is preferable that the shelf width W of the shelf surface 12 at the front end of the bowl 6 (the position A) is 25 to 35 mm. Further, it is preferable that the shelf width W of the shelf surface 12 at the rear end of the bowl 6 (the position G) is 10 to 20 mm.

In the flush toilet 1 according to the present embodiment described above, though the momentum of flush water is weak at the front end of the bowl 6 (the position A), it is possible to cause the flush water to whirl to the vicinity of the rim spout port 20, maintaining the flush water by the shelf surface 12, and flow down, because the shelf width W of the shelf surface 12 is formed the widest at the front end of the bowl 6 (the position A). On the other hand, since the momentum of flush water is strong at the rear end of the bowl 6 (the position G), the flush water does not flow down too much even though the shelf width W of the shelf surface 12 is formed to be the narrowest at the rear end of the bowl 6.

Furthermore, in the present embodiment, the shelf widths W of the rear arc portion 44 of the shelf surface 12 at the positions F, G and H are almost the same. By the shelf width W of the shelf surface 12 changing, it becomes easy for flush water to flow down, and, on the rear arc portion 44, the direction of the flow of the flush water changes, so that disturbance easily occurs. Therefore, by causing the shelf width W of the shelf surface 12 at the positions F, G and H to be almost the same as described above, flush water is prevented from flowing down too much.

Next, an inner curvature radius R3 of an inner coupling portion 54 that couples the shelf surface 12 and the waste receiving surface 8 on the entire circumference of the bowl 6 will be described with reference to FIGS. 11 to 13.

Figure 11:
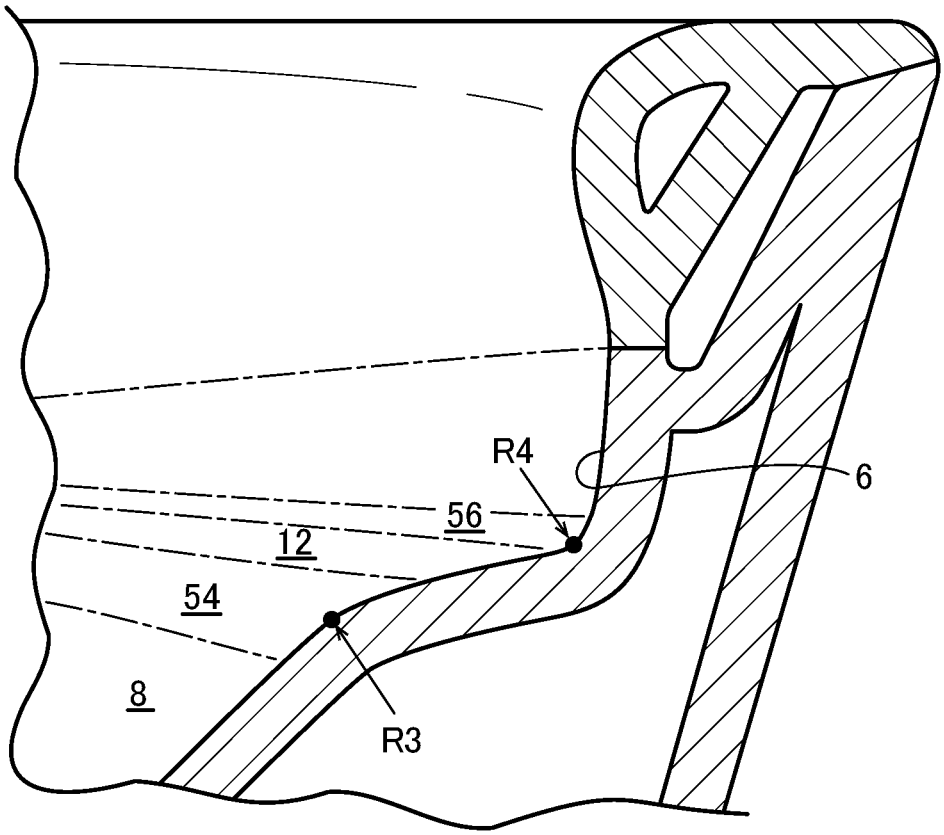
FIG. 11 is a partial sectional view seen along line XI-XI in FIG. 2.

As shown in FIG. 11, the shelf surface 12 and the waste receiving surface 8 are coupled by the inner coupling portion 54. The inner coupling portion 54 is formed by the curvature radius R3 of a convex shape along the vertical direction.

Figures 12, 13:
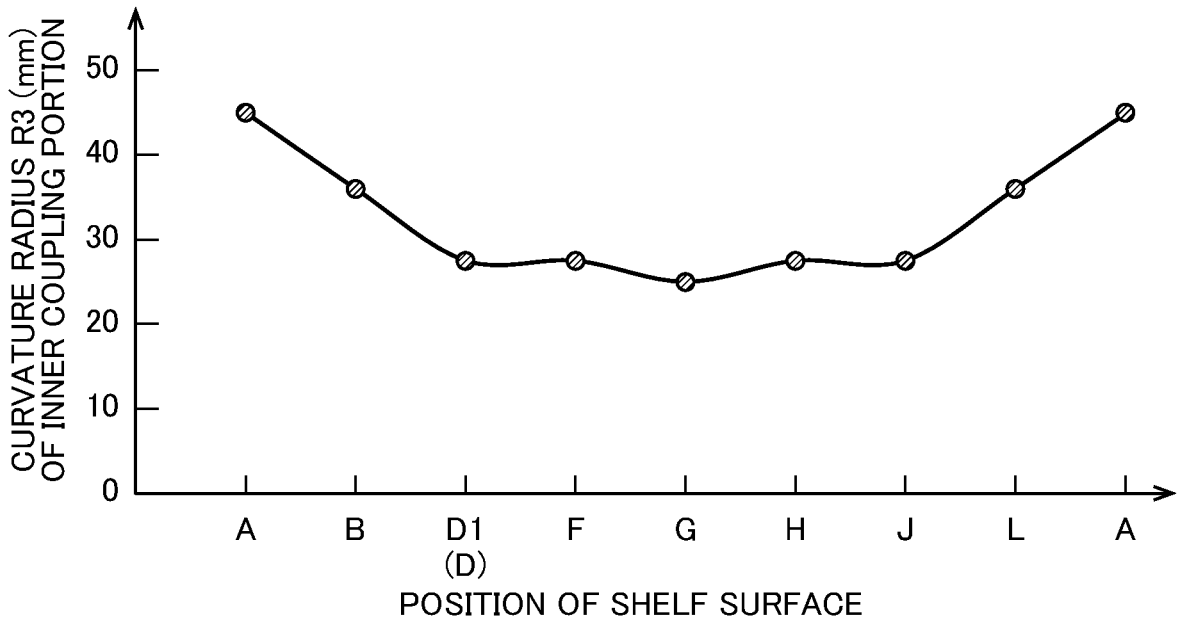
FIG. 12 is a table showing curvature radii R3 of an inner coupling portion that couples the shelf surface and a waste receiving surface, on the entire circumference of the bowl.
FIG. 13 is a line graph showing the curvature radii R3 of the inner coupling portion on the entire circumference shown in FIG. 12.

As shown in FIGS. 12 and 13, the curvature radius R3 of the inner coupling portion 54 has a smaller value at the rear end of the bowl 6 (the position G) than at the front end of the bowl 6 (the position A).

In the flush toilet 1 according to the present embodiment, the curvature radius R3 of the inner coupling portion 54 that couples the shelf surface 12 and the waste receiving surface 8, along the vertical direction has a smaller value at the rear end of the bowl 6 (the position G) than at the front end thereof (the position A). Therefore, in the case of washing the rear area of the bowl 6, flush water easily flows down at the rear end of the bowl 6 (the position G) because the flush water flows from the right-side linear portion 40*a* to the rear arc portion 44 and has a momentum, and disturbance increases. The flush water is prevented from flowing down too much by setting a smaller value for the curvature radius R3 of the inner coupling portion 54 than at the front end (the position A).

On the other hand, in the case of washing the front area of the bowl 6, since the momentum of flush water flowing from the left-side linear portion 40*b* to the front arc portion 42 is weak, and disturbance is small at the front end of the bowl 6 (the position A), it is difficult for the flush water to flow down. Therefore, by setting the curvature radius R3 of the inner coupling portion 54 to a larger value than at the rear end of the bowl 6 (the position G), the flush water is caused to easily flow down. Furthermore, it is also difficult for flush water flowing from the front arc portion 42 to the right-side linear portion 40*a* to flow down. Therefore, by increasing the curvature radius R3 of the inner coupling portion 54 at the front end of the bowl 6 (the position A), the flush water is caused to easily flow down, and it is possible to prevent unwashed parts from occurring on the waste receiving surface 8 near the rim spout port 20.

Furthermore, as shown in FIGS. 12 and 13, the value of the curvature radius R3 of the inner coupling portion 54 increases from the rear end of the bowl 6 (the position G) toward the front end thereof (the position A).

Here, it is preferable that the curvature radius R3 of the inner coupling portion 54 at the front end of the bowl 6 (the position A) is 40 to 45 mm. It is preferable that the curvature radius R3 of the inner coupling portion 54 at the rear end of the bowl 6 (the position G) is 25 to 30 mm.

In the flush toilet 1 according to the present embodiment, flush water is spouted backward from the rim spout port 20 along the right-side linear portion 40*a* of the shelf surface 12. Therefore, flush water has a stronger momentum and is more largely disturbed in the rear area of the bowl 6 than in the front area thereof, and the flush water easily flows down from the shelf surface 12 to the waste receiving surface 8. In the front area of the bowl 6, flush water has a weaker momentum, and disturbance is smaller than in the rear area thereof. Therefore, it is difficult for the flush water to flow down from the shelf surface 12 to the waste receiving surface 8. Therefore, in the flush toilet 1 according to the present embodiment, the value of the curvature radius R3 of the inner coupling portion 54 that couples the shelf surface 12 and the waste receiving surface 8 increases from the rear end of the bowl 6 (the position G) toward the front end (the position A) thereof. Thus, flush water does not flow down too much in the rear area of the bowl 6, and it is easy for flush water to flow down in the front area, so that it is possible to prevent occurrence of unwashed parts on the waste receiving surface 8 of the bowl 6.

Next, an inner curvature radius R4 of an outer coupling portion 56 that couples the shelf surface 12 and the rim 10 on the entire circumference of the bowl 6 will be described with reference to FIGS. 11, 14 and 15.

As shown in FIG. 11, the shelf surface 12 and the rim 10 are coupled by the outer coupling portion 56. The outer coupling portion 56 is formed by the curvature radius R4 of a concave shape along the vertical direction.

Figures 14, 15:
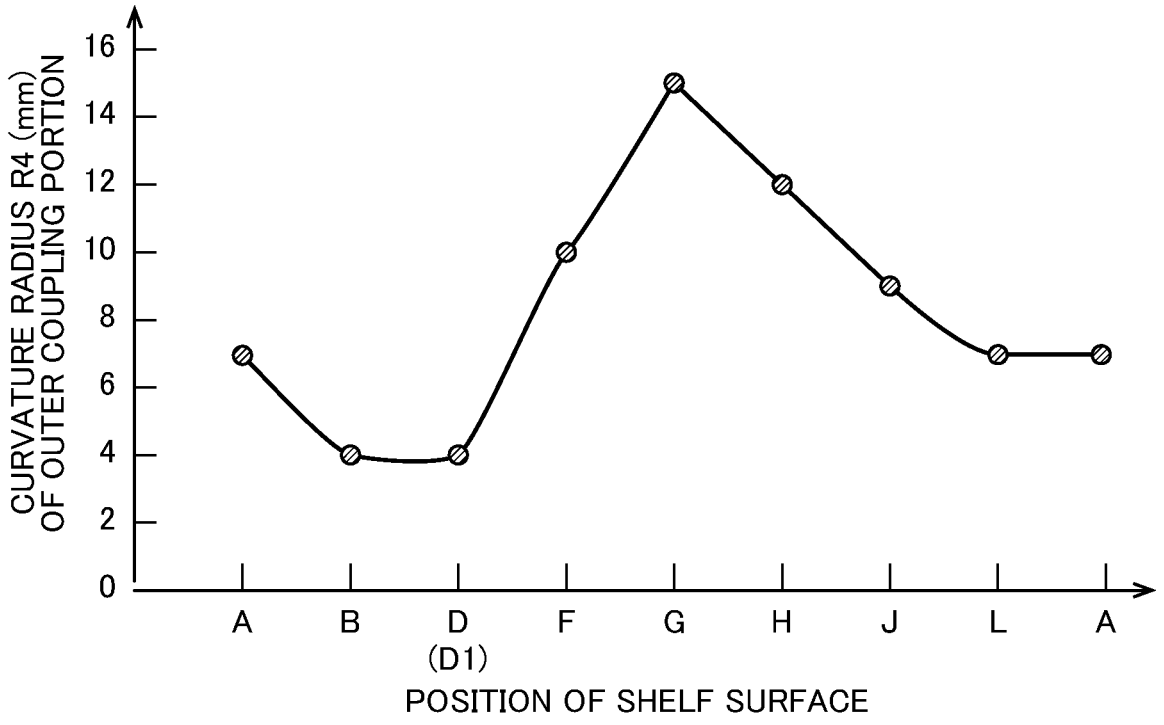
FIG. 14 is a table showing curvature radii R4 of an outer coupling portion that couples the shelf surface and a rim, on the entire circumference of the bowl.
FIG. 15 is a line graph showing the curvature radii R4 of the outer coupling portion that couples the shelf surface and the rim, on the entire circumference shown in FIG. 14.

As shown in FIGS. 14 and 15, the curvature radius R4 of the outer coupling portion 56 has the smallest value near the rim spout port 20 (the position D1) in the right-side area of the bowl 6. Schematically, however, the value of the curvature radius R4 increases from the front end of the bowl 6 (the position A) toward the rear end thereof (the position G).

On the other hand, in the left-side area of the bowl 6, the curvature radius R4 of the outer coupling portion 56 has the smallest value at the front end of the bowl 6 (the position A), and the value of the curvature radius R4 increases toward the rear end of the bowl 6 (the position G).

Here, it is preferable that the curvature radius R4 of the outer coupling portion 56 at the front end of the bowl 6 (the position A) is 6 to 8 mm. It is preferable that the curvature radius R4 of the outer coupling portion 56 at the rear end of the bowl 6 (the position G) is 12 to 15 mm.

In the flush toilet 1 according to the present embodiment, the value of the curvature radius R4 of the outer coupling portion 56 that couples the shelf surface 12 and the rim 10, along the vertical direction increases from the rear end of the bowl 6 (the position G) toward the front end thereof (the position A). Therefore, when it is difficult for flush water to flow down from the shelf surface 12 to the waste receiving surface 8 in the front area of the bowl 6, it becomes easy for the flush water to flow down in the rear area of the bowl 6, and it is possible to, by causing an appropriate amount of flush water to flow down into the rear area of the bowl 6 to wash away adhering waste.

What is claimed is:

1. A flush toilet for discharging waste by using flush water, the flush toilet comprising:

a bowl comprising a waste receiving surface configured to receive the waste, a rim formed on a top edge of the waste receiving surface, and a shelf surface formed between the waste receiving surface and the rim, the shelf surface of the bowl including linear portions formed on a right side and a left side when seen from forward, a front arc portion connected to front ends of the linear portions, and a rear arc portion connected to rear ends of the linear portions;

a rim spout portion configured to spout flush water from a rim spout port provided on the rim to the shelf surface to form a circulating flow; and a water conduit configured to guide flush water supplied from a flush water supply source to the rim spout portion;

wherein flush water is spouted backward from the rim spout port of the rim spout portion along the linear portions of the shelf surface; and the shelf surface and the waste receiving surface are coupled by an inner coupling portion, and a curvature radius of the inner coupling portion along a vertical direction is set to a smaller value on a rear end of the bowl than on a front end thereof.

2. The flush toilet according to claim 1, wherein the curvature radius of the inner coupling portion that couples the shelf surface and the waste receiving surface is set so that a value increases from the rear end of the bowl toward the front end thereof.

3. The flush toilet according to claim 1, wherein the shelf surface and the rim are coupled by an outer coupling portion, and a curvature radius of the outer coupling portion along a vertical direction is set so that a value increases from the front end of the bowl toward the rear end thereof.

4. The flush toilet according to claim 1, wherein the shelf surface is formed such that a shelf width thereof is the widest at the front end of the bowl and the narrowest at the rear end of the bowl.

* * * * *